US007292217B2

(12) United States Patent
Tseng et al.

(10) Patent No.: US 7,292,217 B2
(45) Date of Patent: Nov. 6, 2007

(54) SOURCE DRIVER AND LIQUID CRYSTAL DISPLAY USING THE SAME

(75) Inventors: Der-Yuan Tseng, Taoyuan County (TW); Chih-Hsin Hsu, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 570 days.

(21) Appl. No.: 10/709,641

(22) Filed: May 19, 2004

(65) Prior Publication Data

US 2005/0206629 A1 Sep. 22, 2005

(30) Foreign Application Priority Data

Mar. 18, 2004 (TW) ..... 93107214 A

(51) Int. Cl.
*G09G 3/36* (2006.01)

(52) U.S. Cl. ..... 345/100; 345/209; 327/333

(58) Field of Classification Search ..... 345/98–100, 345/204, 209; 327/333
See application file for complete search history.

(56) References Cited

U.S. PATENT DOCUMENTS 5,731,796 A * 3/1998 Furuhashi et al. ..... 345/96
6,552,708 B1 * 4/2003 Wang et al. ..... 345/98
2003/0155958 A1 * 8/2003 Yamamoto et al. ..... 327/333

* cited by examiner

*Primary Examiner*—Amr A. Awad
*Assistant Examiner*—Yong Sim
(74) *Attorney, Agent, or Firm*—Jianq Chyun IP Office

(57) ABSTRACT

A low-power-consumption source driver for a liquid crystal display is provided. More than one middle voltage level for the level shifter and the output buffer is provided, in addition to the power supply voltage level VDD and the ground level GND, to provide different voltage levels for image data of different polarities. Hence, amplitude of the operational voltage of the level shifters and the analog circuits with different polarities can be reduced. It also can reduce the amplitude of the operational voltage of the level shifter and can reduce significantly the dynamic power consumption of the level shifter and the DAC. Because the voltage amplitude of the circuit is reduced and a low-voltage tolerated device can be used, so that the present invention can further reduce the cost of the circuit.

23 Claims, 2 Drawing Sheets

SOURCE DRIVER AND LIQUID CRYSTAL DISPLAY USING THE SAME

CROSS REFERENCE TO RELATED APPLICATIONS

This application claims the priority benefit of Taiwan application Ser. No. 93107214, filed on Mar. 18, 2004.

BACKGROUND OF INVENTION

1. Field of the Invention

This invention generally relates to a low-power-consumption source driver, and more particularly to a low-power-consumption source driver for a liquid crystal display (LCD).

2. Description of Related Art

FIG. 1 is a structure diagram of a LCD. Referring to FIG. 1, the LCD uses the thin film transistor 100 as a switch. When the gate driver 104 outputs signals to turn on the thin film transistor 100, the source driver 102 will output image data to the liquid crystal, and the liquid crystal change its status according to image data.

FIG. 2 is a block diagram of the source driver of FIG. 1. Referring to FIG. 2, the source driver 102 of the LCD comprises a shift register 200, a latch 202, a level shifter 204, a digital-to-analog converter (DAC) 206 and an output buffer 208. The shift register 200 sequentially writes digital image data into the latch 202. When image data stored in the latch 202 are enough to display a horizontal line, the latch 202 will output image data to the level shifter 204. The level shifter 204 changes the voltage level of digital image data and then outputs image data to the DAC 206. The DAC 206 receives digital image data and then outputs analog image data to the output buffer 208. Finally, the output buffer 208 writes image data to the liquid crystal. The output buffer 208 is constructed by a unit-gain and negative-feedback operational amplifier.

To prevent the liquid crystal from the ion effect, the polarity of the voltage signals applied on the liquid crystal has to be changed continuously. Hence, a portion of the driver circuit, such as the DAC and the output buffer, are classified into the positive and negative types, for example, the positive analog circuit 306 and the negative analog circuit 308 of FIG. 3. Traditionally, the driving voltages for the positive and negative driver circuits are the same. However, the range of the driving voltages should be different for the positive and negative driver circuits.

To make sure that the circuits with different polarities can operate properly, traditionally the range of operational voltage is twice larger than that of the driver circuit with the single polarity. The traditional method has the following drawbacks:

1. The First and second level shifters 302 and 304 will raise the voltage of the input signal to the same voltage. When the voltage level of the input signal is changed, it will increase the power consumption (P=f*C*V2). For example, if the voltage is increased by twice, the power consumption will be increased by four times.

2. When the DACs with the different polarities use the same operational voltage, it also increases the dynamic power consumption under the consideration of the parasitic capacitors Cgs and Cgd.

3. When the output buffers with different polarities use the same operational voltage, it also increases the static power consumption (P=I*V). For example, if the voltage is increased by twice, the static power consumption will be increased by twice.

To reduce the power consumption, the present invention discloses a low-power-consumption source driver to reduce the amplitude of the operational voltage of the level shifters and the analog circuits with different polarities. Hence, the present invention can reduce the power consumption and thus further reduce the cost of the circuit.

SUMMARY OF INVENTION

The present invention is directed to a source driver suitable for a plurality of sources of thin film transistors of an LCD.

The present invention is directed to a low-power-consumption source driver suitable for the thin film transistors of the LCD.

According to an embodiment of the present invention, the source driver comprises a shift register for receiving digital image data; a latch, coupled to the shift register, for receiving digital image data from the shift register; a level shifter, coupled to the latch, for receiving digital image data from the latch and for shifting a voltage level of digital image data; and an analog circuit, coupled to the level shifter, for receiving digital image data, converting digital image data to corresponding analog image data, and outputting analog image data to the sources. A power supply voltage level and a ground voltage level are provided to the level shifter and the analog circuit, and at least one middle voltage level between the power supply voltage level and the ground voltage level is provided to the level shifter and the analog circuit.

In one embodiment of the present invention, each of the level shifter and the analog circuit has a positive polarity and a negative polarity. The power supply voltage level and the middle voltage level are provided to the level shifter with the positive polarity and the analog circuit with the positive polarity. The middle voltage level and the ground level are provided to the level shifter with the negative polarity and the analog circuit with the negative polarity.

In one embodiment of the present invention, when there are two or more middle voltage levels, the middle voltage level provided to the level shifter with the positive polarity and the analog circuit with the positive polarity is larger than the ground level and smaller than or equal to a half of the power supply voltage level and the middle voltage level provided to the level shifter with the negative polarity and the analog circuit with the negative polarity is larger or equal to a half of the power supply voltage level and is smaller than the power supply voltage level.

In one embodiment of the present invention, the latch further comprises a first level latch and a second level latch. The first level latch sequentially receives digital image data. Digital image data comprises image data of sequentially arranged horizontal lines. When the first latch completely receives a image data of one horizontal line, the first latch outputs the image data of one horizontal line to the second level latch and continues receiving one-horizontal-line image data of next horizontal line. The second level latch outputs image data of previous horizontal line to the level shifter.

In one embodiment of the present invention, the digital-to-analog converter with the positive polarity provides an image data conversion with the positive polarity. The digital-to-analog converter with the negative polarity provides an image data conversion with the negative polarity.

In one embodiment of the present invention, the output buffer with the positive polarity can be a unit-gain and negative-feedback operational amplifier. The output buffer with the negative polarity can be a unit-gain and negative-feedback operational amplifier.

The present invention is also directed to a source driver for sources of thin film transistors. The source driver, according to an embodiment of the present invention, comprises an analog circuit with a positive polarity, coupled to a power supply voltage level and a first middle voltage level, receiving a gamma voltage and digital image data to convert digital image data to corresponding analog image data, and outputting analog image data to the sources; an analog circuit with a negative polarity, coupled to a ground level and a second middle voltage level, receiving a gamma voltage and digital image data, converting digital image data to corresponding analog image data, and outputting analog image data to the plurality of sources; a first level shifter, coupled to the power supply voltage level and the first middle voltage level, for receiving input data to convert a voltage level of digital image data, and then output the voltage level of digital image data to the analog circuit with the positive polarity; and a second level shifter, coupled to the ground level and the second middle voltage level, for receiving input data to convert a voltage level of digital image data, and then output the voltage level of digital image data to the analog circuit with the analog circuit with the negative polarity.

In one embodiment of the present invention, when the first middle voltage level and the second middle voltage level are equal, the first middle voltage level is a half of the power supply voltage level and the second middle voltage level is a half of the power supply voltage level.

In one embodiment of the present invention, when the first middle voltage level and the second middle voltage level are not equal, the first middle voltage level is larger than the ground level and smaller than or equal to a half of the power supply voltage level, and the second middle voltage level is larger than or equal to a half of the power supply voltage level and is smaller than the power supply voltage level.

In one embodiment of the present invention, the analog circuit with the positive polarity further comprises a digital-to-analog converter and an output buffer. The output buffer is an output buffer with the positive polarity comprising a unit-gain and negative-feedback operational amplifier.

In one embodiment of the present invention, the analog circuit with the negative polarity further comprises a digital-to-analog converter and an output buffer. The output buffer is an output buffer with the negative polarity comprising a unit-gain and negative-feedback operational amplifier.

In addition, the present invention is also directed to a liquid crystal display. According to an embodiment of the present invention, liquid crystal display comprises a plurality of thin film transistors, each of the thin film transistors having a gate, a source, and a drain; a gate driver circuit, coupled to the gates of the thin film transistors, for outputting a signal to selectively turn on the thin film transistors; and a source driver circuit, coupled to the sources of the thin film transistors. The source driver circuit comprises an analog circuit with a positive polarity, coupled to a power supply voltage level and a first middle voltage level, for receiving a gamma voltage and digital image data to convert digital image data to corresponding analog image data, and then output analog image data to the sources; an analog circuit with a negative polarity, coupled to a ground level and a second middle voltage level, for receiving a gamma voltage and a digital image data to convert digital image data to corresponding analog image data, and then output the analog image data to the sources; a first level shifter, coupled to the power supply voltage level and the first middle voltage level, for receiving input data to convert a voltage level of digital image data, and then output the voltage level of digital image data to the analog circuit with the analog circuit with the positive polarity; and a second level shifter, coupled to the ground level and the second middle voltage level, receiving an input data, converting a voltage level of digital image data, and outputting the voltage level of digital image data to the analog circuit with the analog circuit with the negative polarity.

In one embodiment of the present invention, when the first middle voltage level and the second middle voltage level are equal, the first middle voltage level is a half of the power supply voltage level and the second middle voltage level is a half of the power supply voltage level.

In one embodiment of the present invention, when the first middle voltage level and the second middle voltage level are not equal, the first middle voltage level is larger than the ground level and smaller than or equal to a half of the power supply voltage level, and the second middle voltage level is larger than or equal to a half of the power supply voltage level and is smaller than the power supply voltage level.

In one embodiment of the present invention, the analog circuit with the positive polarity further comprises a digital-to-analog converter and an output buffer; the output buffer is an output buffer with the positive polarity comprising a unit gain negative feedback operational amplifier.

In one embodiment of the present invention, the analog circuit with the negative polarity further comprises a digital-to-analog converter and an output buffer; the output buffer is an output buffer with the negative polarity comprising a unit gain negative feedback operational amplifier.

Because a source driver, according to an embodiment of the present invention, is used to provide more than one middle voltage level for the level shifter and the output buffer, therefore, the amplitude of the operational voltage of the level shifter can be reduced, and the dynamic power consumption of the level shifter and the DAC can also be significantly reduced. In addition, the amplitude of the operational voltage of the output buffer can be reduced, and the static power consumption of the output buffer can also be reduce.

The above is a brief description of some deficiencies in the prior art and advantages of the present invention. Other features, advantages and embodiments of the invention will be apparent to those skilled in the art from the following description, accompanying drawings and appended claims.

DETAILED DESCRIPTION

As described above, to prevent the liquid crystal from the ion effect, the polarity of the voltage signals applied on the liquid crystal has to be changed continuously. Hence, the driver circuit such as the DAC and the output buffer are classified into the positive polarity and negative polarity. Traditionally, the driving voltages for the positive and negative driver circuits are the same, for example the ground GND and the power supply VDD. To make sure that the circuits with different polarities can operate properly, traditionally the range of operational voltage is twice larger than that of the driver circuit with the single polarity.

Hence, it increases not only the dynamic power consumption of the level shifter and the DACs, but also the static power consumption of the output buffer. To resolve the power consumption issue of the prior art, the present invention, in addition to the ground GND and the power supply voltage VDD, provides at least one middle voltage level to reduce the amplitude variation of the operational voltage.

In addition, the above latch can be a two-level latch. The first level latch sequentially receives digital image data. Digital image data comprises a plurality of one-horizontal-line image data in order. When the first level latch completely receives image data of one horizontal line, the first level latch outputs image data of one horizontal line to the second level latch and continues receiving image data of next horizontal line. The second level latch outputs image data to the level shifter.

Figure 1:
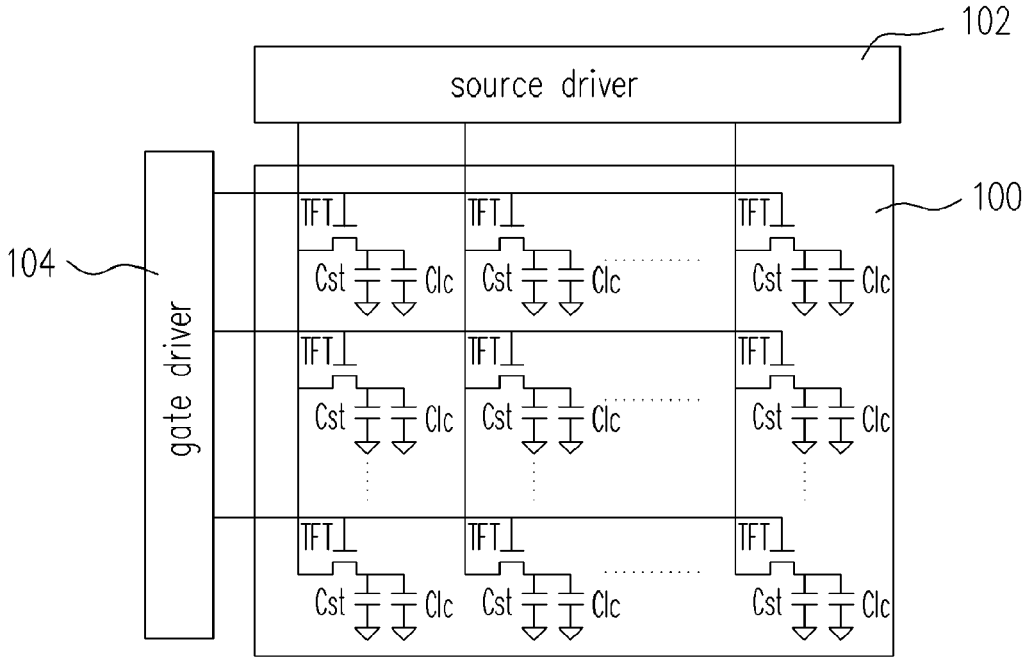
FIG. 1 (PRIOR ART)
FIG. 1 is a structure diagram of an LCD.
Figure 2:
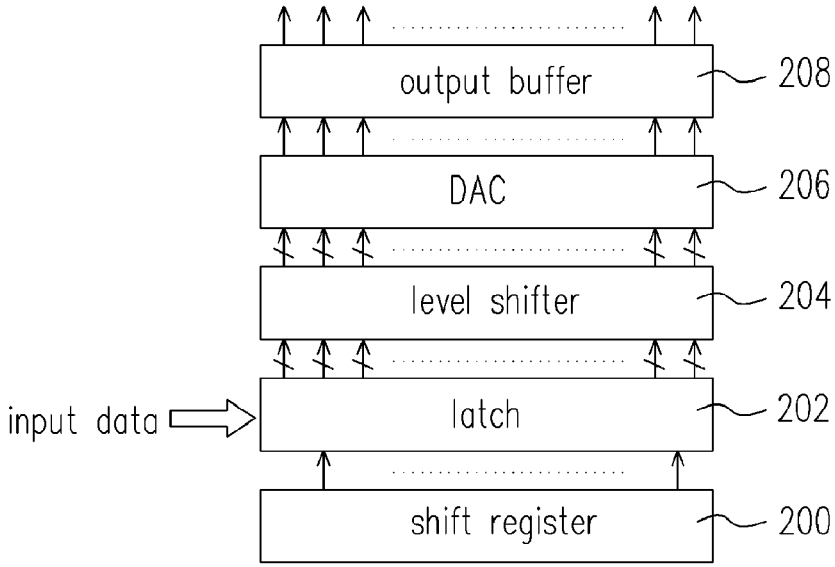
FIG. 2 (PRIOR ART)
FIG. 2 is a block diagram of the source driver of FIG. 1.
Figure 3:
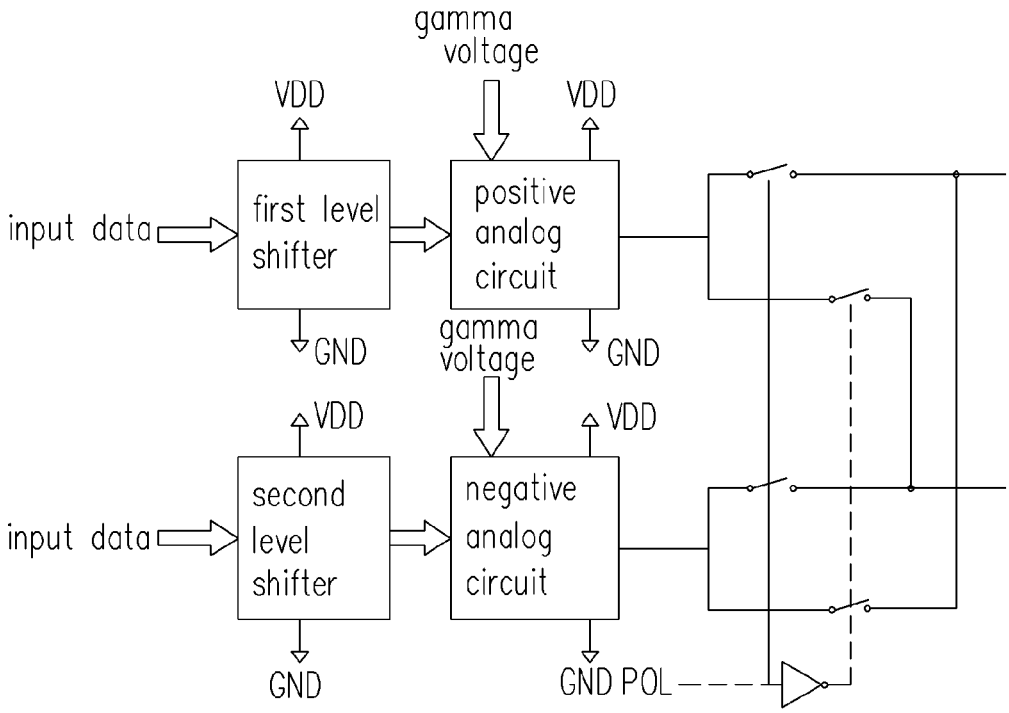
FIG. 3 is a circuit diagram of a traditional driver circuit.
Figure 4:
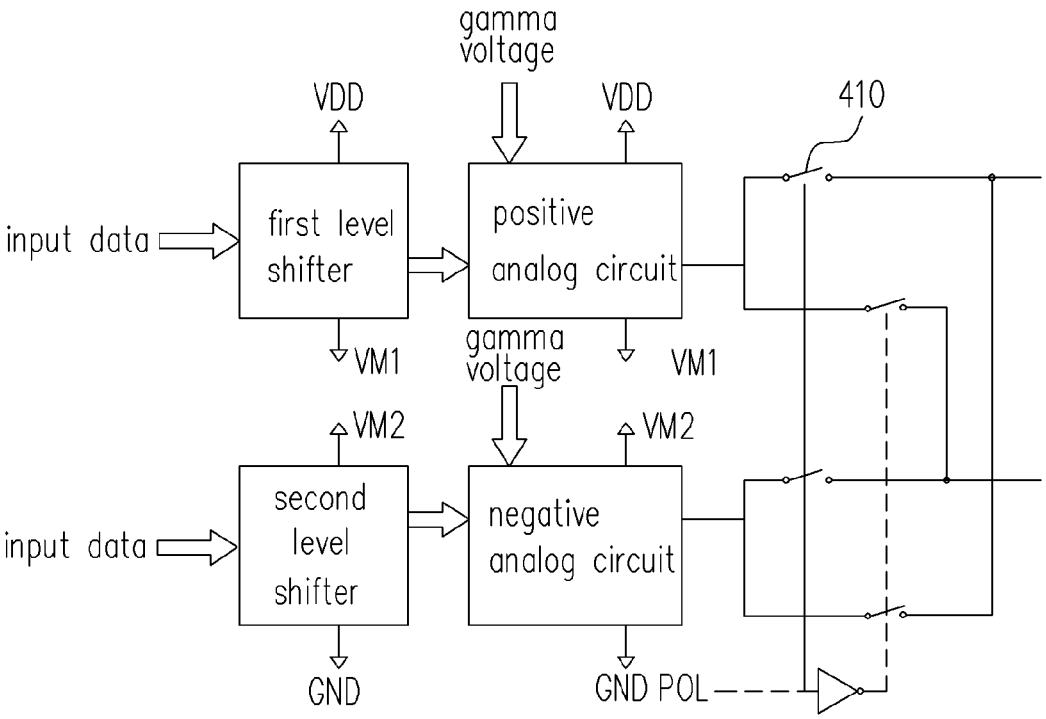
FIG. 4 is a block diagram of a portion of a source driver in accordance with an embodiment of the present invention.

FIG. 4 is a block diagram of a portion of a source driver in accordance with an embodiment of the present invention. As shown in FIG. 4, the source driver comprises the analog circuit with the positive polarity 406, coupled to a power supply voltage level VDD and a first middle voltage level VM1, for receiving a gamma voltage and digital image data, converting digital image data to analog image data, and outputting analog image data to the sources; an analog circuit with the negative polarity 408, coupled to a ground level GND and a second middle voltage level VM2, receiving a gamma voltage and digital image data, converting digital image data to corresponding analog image data, and outputting analog image data to the sources; a first level shifter 402, coupled to the power supply voltage level VDD and the first middle voltage level VM1, for receiving input data, converting a voltage level of digital image data, and outputting the voltage level of digital image data to the analog circuit with the analog circuit with the positive polarity 406; and a second level shifter, coupled to the ground level VDD and the second middle voltage level VM2, receiving an input data, converting a voltage level of digital image data, and outputting the voltage level of digital image data to the analog circuit with the analog circuit with the negative polarity 408.

The analog circuit with the positive polarity 406 and the analog circuit with the negative polarity 408 respectively output to the data lines with odd numbers and the data lines with even numbers via the output stage 410. Via the control of the timing controller (not shown), the output of the analog circuit with the positive polarity 406 and the analog circuit with the negative polarity 408 will reverse after a predetermined period; i.e., the analog circuit with the positive polarity 406 and the analog circuit with the negative polarity 408 respectively output to the data lines with even numbers and the data lines with odd numbers via the output stage 410. By alternate changes, the LCD panel will be driven to display the image data.

The above analog circuit with the positive polarity comprises a digital-to-analog converter with the positive polarity and an output buffer with the positive polarity. The output buffer with the positive polarity can be a unit-gain and negative-feedback operational amplifier. The above analog circuit with the negative polarity comprises a digital-to-analog converter with the negative polarity and an output buffer with the negative polarity. The output buffer with the negative polarity can be a unit-gain and negative-feedback operational amplifier.

As described above, the power source for the analog circuit with the positive polarity 406 and the first level shifter 402 is between the power supply voltage level VDD and the first middle voltage level VM1. Hence the amplitude variation is VDD−VM1, which is much less than the traditional VDD−GND. In addition, the power source for the analog circuit with the negative polarity 408 and the second level shifter 404 is between the power supply voltage level VDD and the second middle voltage level VM2. Hence the amplitude variation is VDD−VM2, which is much less than the traditional VDD−GND. Hence the amplitude variation of the operational voltage of the analog circuit with the positive polarity 406, the analog circuit with the negative polarity 408, and the first level shifter 402 and the second level shifter 404 is reduced significantly.

According to an embodiment of the present invention, the middle voltage level is set as follows. If the middle voltage level is a single power source, i.e., if the first middle voltage level VM1 and the second middle voltage level VM2 are the same, the first middle voltage level and the second middle voltage level VM1=VM2 can be set as VDD/2. When there are two or more power sources, i.e., when the first middle voltage level VM1 is not the same as the second middle voltage level VM2, the first middle voltage level VM1 is larger than the ground level GND and smaller or equal to VDD/2; and the second middle voltage level is larger than or equal to VDD/2 and is smaller than the power supply voltage level GND. The range of the operational voltage of the DAC will be reduced significantly because when the amplitude of the output voltage of the level shifter is reduced for different polarities.

Because the dynamic power consumption is $P=f*C*V^2$ (f is the operational frequency of the signal; C is the capacitor loading; V is the amplitude of the operational voltage), the reduction of the amplitude of the operational voltage can reduce the dynamic power consumption of the level shifter and the analog converter. As for the output buffer, the static power consumption of the operational amplifier is $P=I*V$ (I is the current; V is the operational voltage). Hence, the reduction of the amplitude of the operational voltage can reduce the static power consumption of the output buffer.

Hence by reducing the amplitude of the operational voltage of the level shifter, it can reduce significantly the dynamic power consumption of the level shifter and the DAC. In addition, it can reduce the amplitude of the operational voltage of the output buffer and can significantly reduce the static power consumption of the output buffer. Because the voltage amplitude of the circuit is reduced and the low-voltage tolerated device can be used, the present invention can further reduce the cost of the circuit.

While the present invention has been described with a preferred embodiment, this description is not intended to limit our invention. Various modifications of the embodiment will be apparent to those skilled in the art. It is therefore contemplated that the appended claims will cover any such modifications or embodiments as fall within the true scope of the invention.

The invention claimed is:

1. A source driver for driving sources of a plurality of thin film transistors, the source driver comprising:

a shift register, for receiving digital image data;

a latch, coupled to the shift register, for receiving digital image data from the shift register;

a first level shifter with a positive polarity and a second level shift with a negative polarity, coupled to the latch, for receiving digital image data from the latch and for shifting a voltage level of digital image data; and a first analog circuit with a positive polarity and a second analog circuit with a negative polarity, coupled to the first level shifter with the positive polarity and the second level shifter with the negative polarity respectively, for receiving the digital image data, converting the digital image data to a corresponding analog image data, and outputting the analog image data to the plurality of sources of the thin film transistors;

wherein a power supply voltage level and a middle voltage level between the power supply voltage level and a ground voltage level are provided to the first level shifter with the positive polarity and the first analog circuit with the positive polarity; and the middle voltage level and the ground voltage level are provided to the second level shifter with the negative polarity and the second analog circuit with the negative polarity.

2. The source driver of claim 1, wherein when there are two or more middle voltage levels are provided, the middle voltage level provided to the first level shifter with the positive polarity and the first analog circuit with the positive polarity is larger than the ground voltage level and equal to or less than a half of the power supply voltage level, and the middle voltage level provided to the second level shifter with the negative polarity and the second analog circuit with the negative polarity is larger than or equal to a half of the power supply voltage level and is smaller than the power supply voltage level.

3. The source driver of claim 1, wherein the latch further comprises a first level latch and a second level latch, wherein the first level latch sequentially receives digital image data, and digital image data comprises image data of horizontal lines, and the horizontal lines are sequentially arranged, when the first latch completely receives image data of one horizontal line, the first latch outputs image data of the one horizontal line to the second level latch, and continues receiving image data of next horizontal line, the second level latch outputs the image data of the one horizontal line to the first level shifter with the positive polarity and the second level shifter with the negative polarity.

4. The source driver of claim 1, wherein the first analog circuit with the positive polarity comprises a digital-to-analog converter with the positive polarity and an output buffer with the positive polarity.

5. The source driver of claim 4, wherein the digital-to-analog converter with the positive polarity provides an image data conversion with the positive polarity.

6. The source driver of claim 4, wherein the output buffer with the positive polarity is a unit-gain and negative-feedback operational amplifier.

7. The source driver of claim 1, wherein the second analog circuit with the negative polarity comprises a digital-to-analog converter with the negative polarity and an output buffer with the negative polarity.

8. The source driver of claim 7, wherein the digital-to-analog converter with the negative polarity provides an image data conversion with the negative polarity.

9. The source driver of claim 7, wherein the output buffer with the negative polarity is a unit-gain and negative-feedback operational amplifier.

10. A source driver for a plurality of sources of a plurality of thin film transistors, comprising:

an analog circuit with a positive polarity, coupled to a power supply voltage level and a first middle voltage level, receiving a gamma voltage and digital image data, converting digital image data to corresponding analog image data, and outputting analog image data to the sources;

an analog circuit with a negative polarity, coupled to a ground level and a second middle voltage level, receiving a gamma voltage and digital image data, converting digital image data to corresponding analog image data, and outputting analog image data to the sources;

a first level shifter, coupled to the power supply voltage level and the first middle voltage level, receiving input data, converting a voltage level of digital image data, and outputting the voltage level of digital image data to the analog circuit with the analog circuit with the positive polarity; and a second level shifter, coupled to the ground level and the second middle voltage level, receiving input data, converting a voltage level of digital image data, and outputting the voltage level of digital image data to the analog circuit with the analog circuit with the negative polarity.

11. The source driver of claim 10, wherein when the first middle voltage level is the same as the second middle voltage level, the first middle voltage level is a half of the power supply voltage level and the second middle voltage level is a half of the power supply voltage level.

12. The source driver of claim 10, wherein when the first middle voltage level and the second middle voltage level are not equal, the first middle voltage level is larger than the ground level and smaller than or equal to a half of the power supply voltage level, and the second middle voltage level is larger than or equal to a half of the power supply voltage level and is smaller than the power supply voltage level.

13. The source driver of claim 10, wherein the analog circuit with the positive polarity comprises a digital-to-analog converter and an output buffer.

14. The source driver of claim 13, wherein the output buffer is an output buffer with the positive polarity comprising a unit-gain and negative-feedback operational amplifier.

15. The source driver of claim 10, wherein the analog circuit with the negative polarity comprises a digital-to-analog converter and an output buffer.

16. The source driver of claim 15, wherein the output buffer is an output buffer with the negative polarity comprising a unit-gain and negative-feedback operational amplifier.

17. A liquid crystal display, comprising:

a plurality of thin film transistors, each of the thin film transistors having a gate, a source, and a drain;

a gate driver circuit, coupled to the gates of the thin film transistors, for outputting a signal to selectively turn on the thin film transistors; and a source driver circuit, coupled to the sources of the thin film transistors, the source driver circuit comprising:

an analog circuit with a positive polarity, coupled to a power supply voltage level and a first middle voltage level, receiving a gamma voltage and digital image data, converting digital image data to corresponding analog image data, and outputting analog image data to the sources;

an analog circuit with a negative polarity, coupled to a ground level and a second middle voltage level, receiving a gamma voltage and digital image data, converting digital image data to corresponding analog image data, and outputting analog image data to the sources;

a first level shifter, coupled to the power supply voltage level and the first middle voltage level, receiving input data, converting a voltage level of digital image data, and outputting the voltage level of digital image data to the analog circuit with the analog circuit with the positive polarity; and a second level shifter, coupled to the ground level and the second middle voltage level, receiving input data, converting a voltage level of digital image data, and outputting the voltage level of digital image data to the analog circuit with the analog circuit with the negative polarity.

18. The liquid crystal display of claim 17, wherein when the first middle voltage level is the same as the second middle voltage level, the first middle voltage level is a half of the power supply voltage level and the second middle voltage level is a half of the power supply voltage level.

19. The liquid crystal display of claim 17, wherein when the first middle voltage level is not the same as the second middle voltage level, the first middle voltage level is larger than the ground level and smaller than or equal to a half of the power supply voltage level, and the second middle voltage level is larger than or equal to a half of the power supply voltage level and is smaller than the power supply voltage level.

20. The liquid crystal display of claim 17, wherein the analog circuit with the positive polarity comprises a digital-to-analog convener and an output buffer.

21. The liquid crystal display of claim 20, wherein the output buffer is an output buffer with the positive polarity comprising a unit-gain and negative-feedback operational amplifier.

22. The liquid crystal display of claim 17, wherein the analog circuit with the negative polarity comprises a digital-to-analog convener and an output buffer.

23. The liquid crystal display of claim 22, wherein the output buffer is an output buffer with the negative polarity comprising a unit-gain and negative-feedback operational amplifier.

* * * * *